US008766862B2

(12) United States Patent
Konanur et al.

(10) Patent No.: US 8,766,862 B2
(45) Date of Patent: Jul. 1, 2014

(54) SIGNAL FEED APPARATUS FOR ANTENNA

(75) Inventors: Anand S. Konanur, San Jose, CA (US); Ulun Karacaoglu, San Diego, CA (US)

(73) Assignee: Intel Corporation, Santa Clara, CA (US)

( * ) Notice: Subject to any disclaimer, the term of this patent is extended or adjusted under 35 U.S.C. 154(b) by 176 days.

(21) Appl. No.: 13/536,448

(22) Filed: Jun. 28, 2012

(65) Prior Publication Data

US 2014/0002312 A1 Jan. 2, 2014

(51) Int. Cl.
*H01Q 13/10* (2006.01)
*H01Q 1/24* (2006.01)

(52) U.S. Cl.
CPC . *H01Q 13/10* (2013.01); *H01Q 1/24* (2013.01)
USPC ..... 343/702; 343/767

(58) Field of Classification Search
CPC ..... H01Q 13/10; H01Q 13/18; H01Q 13/12; H01Q 1/24
USPC ..... 343/702, 906, 767, 904
See application file for complete search history.

(56) References Cited

U.S. PATENT DOCUMENTS

| | | | | |
|---|---|---|---|---|
| 2009/0140937 | A1* | 6/2009 | Chow et al. | 343/702 |
| 2011/0043413 | A1* | 2/2011 | Zadesky et al. | 343/702 |
| 2011/0241948 | A1* | 10/2011 | Bevelacqua et al. | 343/702 |
| 2012/0274346 | A1* | 11/2012 | Nickel et al. | 324/754.03 |
| 2013/0342411 | A1* | 12/2013 | Jung et al. | 343/767 |

* cited by examiner

*Primary Examiner* — Hoanganh Le
(74) *Attorney, Agent, or Firm* — Garrett IP, LLC

(57) ABSTRACT

A signal feed apparatus for an antenna including a slot through a conductive wall, comprises a non-conductive slot insert, a non-conductive block fixed to the slot insert and including first and second cable conduits and first and second plug sockets coinciding with first and second signal feed-points of the antenna. A signal cable is inserted into the cable conduits and includes first and second conductors. Conductive plugs are inserted into the first and second plug sockets to electrically connect the conductors to the first and second signal feed-points.

24 Claims, 12 Drawing Sheets

SIGNAL FEED APPARATUS FOR ANTENNA

BACKGROUND

An antenna requires a signal feed that provides a signal to be transmitted to the antenna. As portable communication devices have become smaller, so too have their antennas and signal feeds become correspondingly smaller. The manufacture and assembly of such small components in an efficient, cost effective manner, suitable for high volume production, is highly desirable, but presents a challenge, especially with respect to integrating the signal feed in the antenna. A conventional technique involves soldering conductors of a coaxial cable, i.e., the signal feed, to signal feed-points on the antenna. This approach is time-consuming and prone to error. Moreover, the solder connections tend to fracture and then form an intermittent electrical connection over time, especially when the portable communication device is subject to frequent and vigorous motion.

BRIEF DESCRIPTION OF THE DRAWINGS/FIGURES

Figure 1:
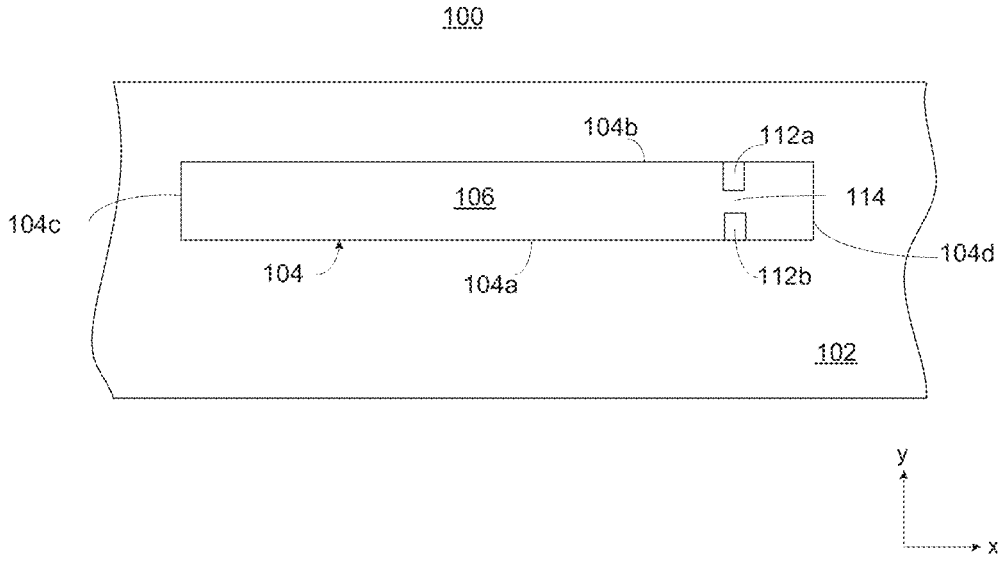
FIG. 1 is a diagram of a slot antenna absent a signal feed apparatus, according to an embodiment.

In the drawings, the leftmost digit(s) of a reference number identifies the drawing in which the reference number first appears.

DETAILED DESCRIPTION

Multiple antenna assemblies are described below. The antenna assemblies each include a slot antenna having a signal feed apparatus incorporated into the slot antenna to provide a signal to be transmitted, to the antenna. While the slot antenna may be configured similarly in each antenna assembly, the signal feed apparatus is configured according to different embodiments. Accordingly, the slot antenna is described first below. Then, the multiple antenna assemblies are described with emphasis on their different signal feed apparatuses.

FIG. 1 is a diagram of a slot antenna 100 absent a signal feed apparatus. Slot antenna 100 includes a substantially planar electrically conductive surface or wall 102, which may be part of a wall of a chassis or housing of any wireless communication device (not shown in FIG. 1). Conductive wall 102 includes a peripheral edge or periphery 104 defining a perimeter of an elongate opening or slot 106 (also referred to herein as an antenna slot 106) through the conductive wall. Periphery 104 includes opposing sides or lengths 104*a*, 104*b* extending along a length of slot 106 (in the x-direction), and opposing ends or widths 104*c*, 104*d*. Slot 106 provides open communication between an interior and exterior of any housing of which conductive wall 102 is a part. The dimensions of slot 106 correspond to a center frequency, e.g., 2.4 GHz, and a corresponding wavelength, at which slot antenna 100 is designed to operate. The length of slot 106 (in the x-direction) is approximately a ½ wavelength, and a width (in the y-direction) of the slot is approximately a ¼ wavelength, of the center wavelength to be transmitted. Exemplary approximate dimensions of slot 106 are 60 millimeters (mm) in length and between 8 and 9 mm in width, for a center operating frequency of 2.1 GHz.

Conductive wall 102 also includes first and second rectangular antenna slot protuberances 112*a*, 112*b* each extending from corresponding ones of opposing sides 104*a*, 104*b* of periphery 104 toward each other in the x-y plane, to define a narrowed opening 114 between respective free ends of the protuberances. An exemplary spacing between the free-ends is between 2 and 3 mm. In other embodiments, protuberances 112 may be triangular, elliptical, or may assume other shapes. Protuberances 112*a*, 112*b* are positioned substantially nearer to end 104*d* than to end 104*c*. Protuberances 112*a*, 112*b* coincide with first and second opposing signal feed-points of slot antenna 100. The lengths (in the y-direction) of protuberances 112*a*, 112*b*, and thus the separation between their free-ends are adjusted to accommodate signal connectors of different sizes, as will become apparent from the description below. An alternative embodiment includes only one protuberance, in which case the opposing signal feed-points coincide with the one protuberance and a point on the opposing side of slot 106. Alternatively, the protuberances may be omitted entirely, in which case the signal feed-points coincide with points on the opposing sides of slot 106 (absent the protuberances).

Figure 2:
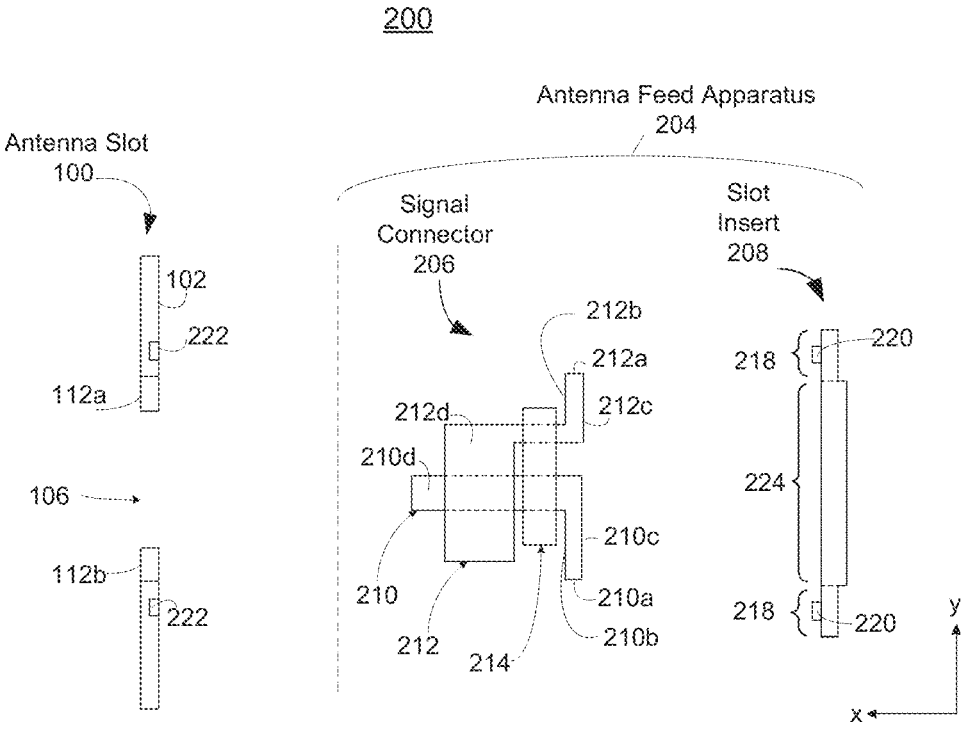
FIG. 2 is a side view of an antenna assembly depicted in a disassembled configuration, according to an embodiment.

FIG. 2 is a side view of an antenna assembly 200 depicted in a disassembled configuration, according to an embodiment. Antenna assembly 200 is depicted in an assembled configuration in FIGS. 3-7. Antenna assembly 200 includes slot antenna 100, and a signal feed apparatus 204 to be incorporated into or integrated with the slot antenna when assembled. Signal feed apparatus 204 includes a signal connector 206 and a slot insert 208. Signal feed apparatus 204 carries radio frequency (RF) signals to be transmitted to slot antenna 100. Also, signal feed apparatus 204 may carry RF signals received by antenna 100.

As best seen in FIG. 2, signal connector 206 includes first and second separated signal conductors 210, 212 each extending through and embedded in a non-conductive, e.g., plastic, connector frame 214. Connector frame 214 fixes first and second conductors 210, 212 in position relative to, and in electrical isolation from, each other, and provides structural integrity to the connector 206. Signal conductors 210, 212 may be made of any electrically conductive material, such as, but not limited to, gold, copper, or a combination thereof, as would be appreciated by those of skill in the relevant arts.

First conductor 210 includes a base 210*a* extending downwardly (i.e., in the -y direction) in a transverse plane (i.e., x-y plane), and which includes a front surface 210*b* facing slot antenna 100 and a back face 210*c* facing slot insert 208. First conductor 210 also includes a free-end 210*d*, extending away from base 210*b* in an axial direction (i.e., z-direction) that is orthogonal to the transverse direction, to mate with a complementary signal connector (not shown).

Second conductor 212 includes a base 212*a* extending upwardly (i.e., in the y direction) in the transverse plane, and which includes a front surface 212*b* facing slot antenna 100 and a back surface 212*c* facing slot insert 208. Second conductor 212 also includes a free-end 212*d*, extending away from base 212*b* in the axial direction, to mate with the complementary signal connector. First and second free-ends 210*d*, 212*d* form inner and concentric outer conductors of a coaxial signal connector, respectively, to mate with a complimentary coaxial signal connector. Concentric outer conductor 212*d* has an exemplary diameter of approximately 1 mm.

Slot insert 208 has a transverse surface area (i.e., in the x-y plane) slightly larger, i.e., longer and wider, than slot 106 to cover the slot 106, and to create a periphery 218 of the slot insert that overlaps a coextensive portion of periphery 104 of slot 106 when the slot insert is brought adjacent to the slot. In another embodiment, slot insert 208 may only partially cover slot 106. Slot insert 208 is made of an electrically non-conductive material so as not to interfere with or influence the RF radiation properties of slot antenna 100. For example, slot insert may be made of a plastic material or any other non-conductive resilient material. Slot insert 208 includes fasteners 220 positioned along periphery 218 to engage complementary fasteners 222 in periphery 104 of slot 106, and thereby fix the slot insert against conductive wall 102 of the slot antenna. Fasteners 220, 222 may be press-fit fasteners, such as snaps, screws, rivets, or any other type of suitable fastener, as would be appreciated by those of ordinary skill in the relevant arts. Alternative and/or additionally, slot insert 208 may be fixed to conductive wall 102 with an epoxy. Alternatively and/or additionally, periphery 104 of slot 106 may include a recess, such as a J-channel, into which periphery 218 of slot insert 208 may be press-fit (as described below in connection with FIG. 8).

Slot insert 208 also includes a recess 224 in an interior thereof to receive and press against first and second conductor bases 210*c*, 212*c*, as will be described below.

Figure 3:
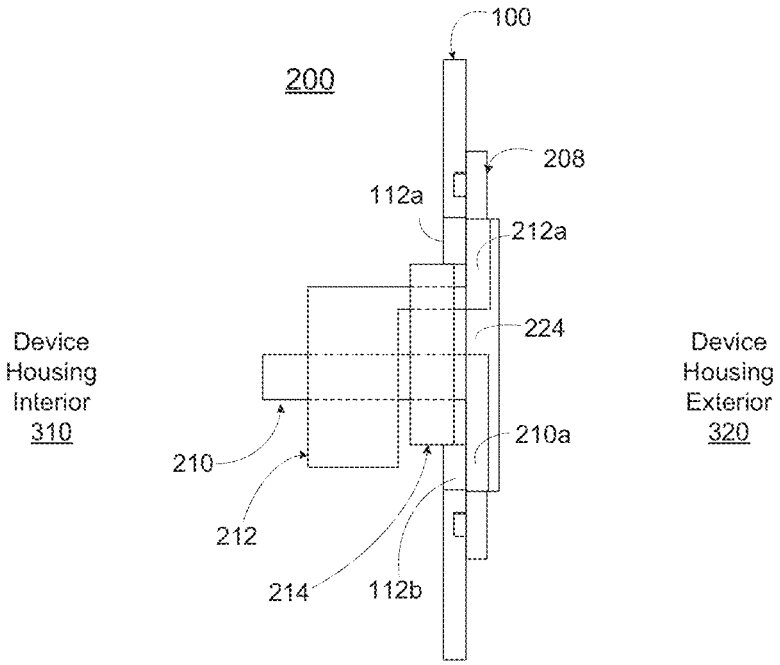
FIG. 3 is a side view of the antenna assembly of FIG. 2 in an assembled configuration, in which a signal connector and a slot insert of a signal feed apparatus are incorporated into a slot antenna, according to an embodiment.

The assembly of antenna assembly 200 is now described with reference to FIG. 2 and FIG. 3. FIG. 3 is a side view of antenna assembly 200 in an assembled configuration, in which signal connector 206 and slot insert 208 of signal feed apparatus 204 are incorporated into slot antenna 100. To assemble antenna assembly 200, signal connector free-ends 210*d*, 212*d* are inserted through slot 106 in the axial direction (i.e., x-direction), thereby bringing the front faces 210*b*, 212*b* of first and second conductor bases 210*a*, 212*a* into contact with adjacent surfaces of protuberances 112*b*, 112*a*, respectively. In other words, such insertion brings first and second conductors 210, 212 into contact with first and second protuberances 112*b*, 112*a*, and thus the antenna signal feed-points, on opposing sides of slot antenna 100. The lengths of protuberances 112*a*, 112*b* are adjusted to accommodate signal connectors of differing size, e.g., protuberances 112 may be shortened to accommodate commensurately larger diameter signal connectors or lengthened to accommodate commensurately smaller diameter signal connectors, to ensure an overlap, and thus contact, between the conductor bases and the protuberances.

Once signal connector 206 is positioned against protuberances 112*a*, 112*b* as described above, then slot insert 208 is positioned adjacent slot antenna 100 so that fasteners 222, 220 are aligned, or coincide, with each other, and conductor bases 210*a*, 212*a* are received in recess 224 of the slot insert. From this position, slot insert 208 is pressed further against slot antenna 100 (in the x-direction) such that the fasteners 222, 220 engage with each other and fix the slot insert against the slot antenna. In this fixed position, conductor bases 212*a*, 212*b* are sandwiched, under pressure, between slot insert recess 224 and protuberances 112*b*, 112*a*, respectively. The assembled configuration obviates the need for soldering or gluing together of parts. In the assembled configuration depicted in FIG. 3, signal connector free-ends 210*d*, 212*d* extend into an interior 310 of a housing in which antenna assembly 200 is incorporated, so that the connector free-ends are able to be connected to signal cabling accessible within the housing, e.g., from a transceiver within the housing. On the other hand, the back side (right-hand side in FIG. 3) of antenna insert 208 faces an exterior of the housing of which antenna assembly 200 forms a part.

Figure 4:
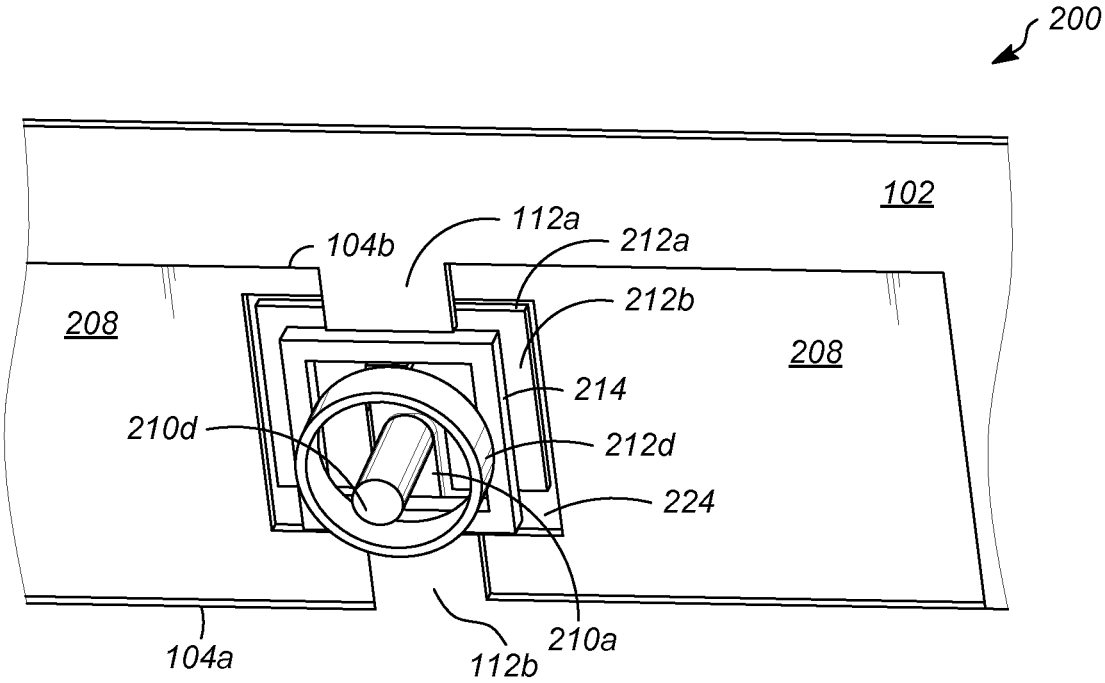
FIG. 4 is a tilted front-perspective view of the antenna assembly of FIG. 3.
Figure 5:
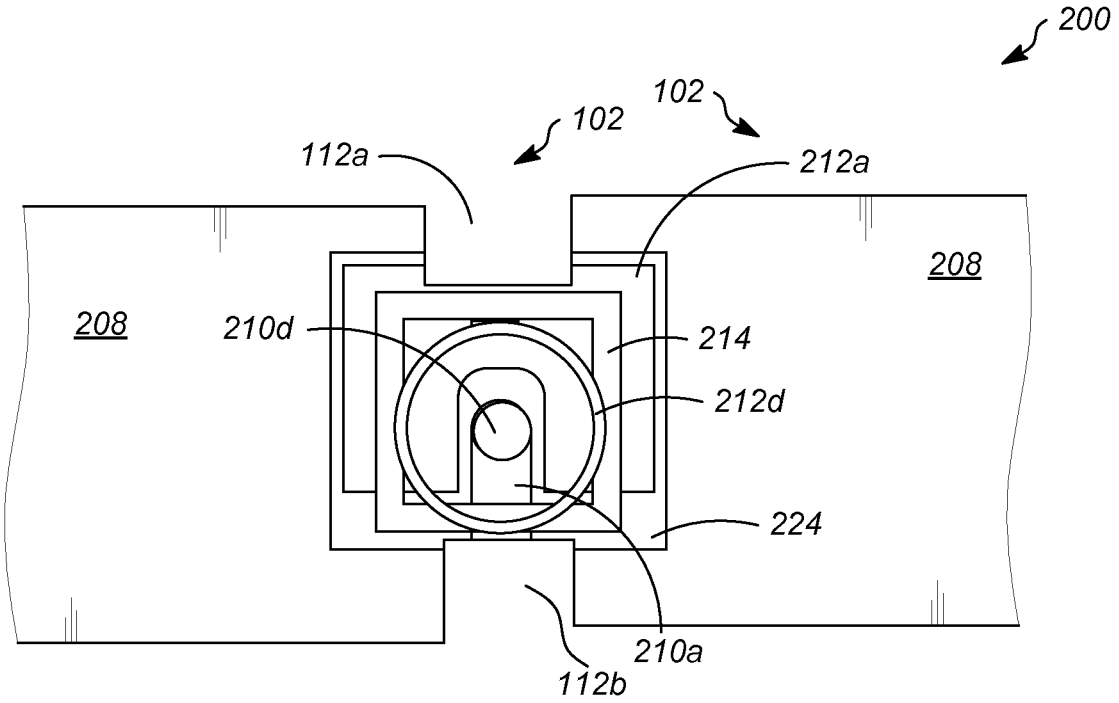
FIG. 5 is a zoomed-in front view of the antenna assembly of FIG. 3.
Figure 6:
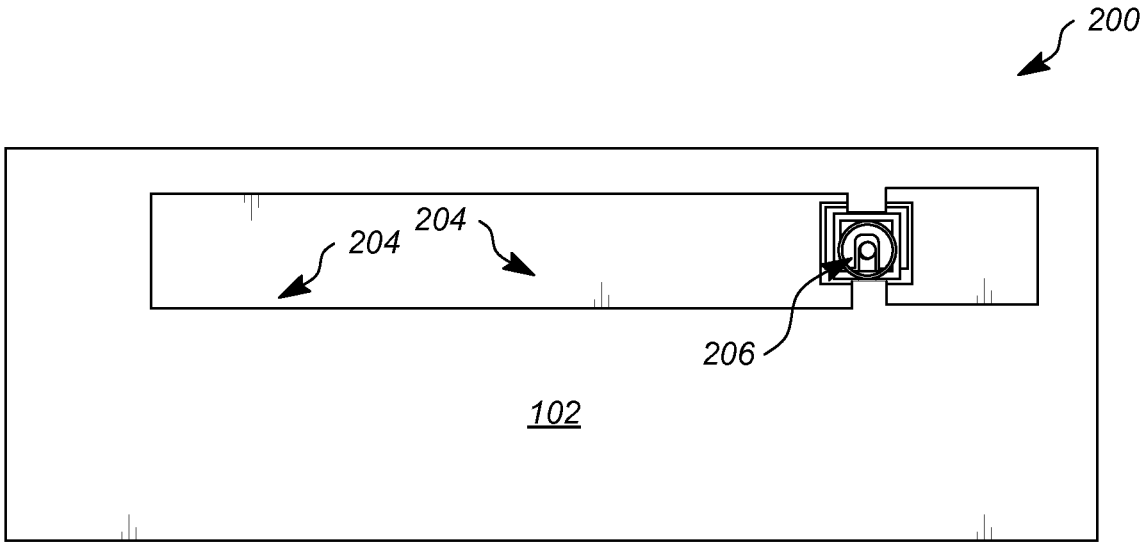
FIG. 6 is a zoomed-out front view of the antenna assembly of FIG. 3.

FIGS. 4-6 are diagrams showing different views of antenna assembly 200 as assembled in FIG. 3.

FIG. 4 is a tilted front-perspective view of antenna assembly 200. The tilted front-perspective view is a view seen when looking at antenna assembly 200 from interior 310 of the housing in which the antenna assembly is installed.

FIG. 5 is a zoomed-in front view of antenna assembly 200.

FIG. 6 is a zoomed-out front view of antenna assembly 200.

Figure 7:
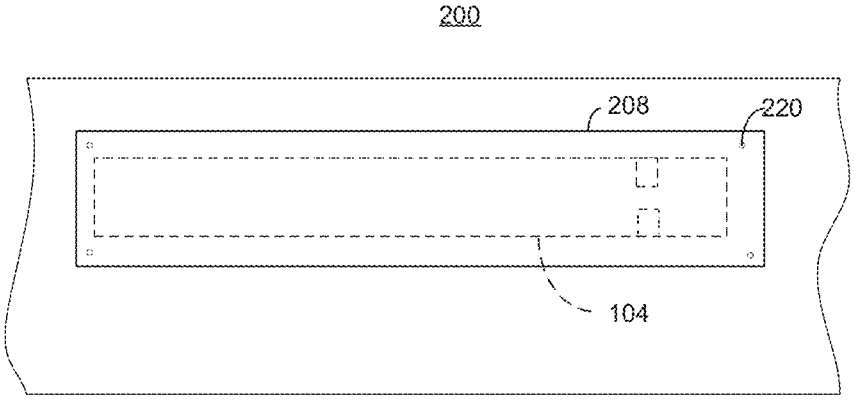
FIG. 7 is a back view of the antenna assembly of FIG. 3.

FIG. 7 is a back view of antenna assembly 200. The back view is a view seen when looking at antenna assembly 200 from exterior 320 of the housing of the device in which the antenna assembly is installed. In an embodiment where periphery 218 of slot insert 208 is pressed into a J-channel, or other recess, coinciding with periphery 104 of slot 106, fasteners 220 may be omitted.

Figure 8:
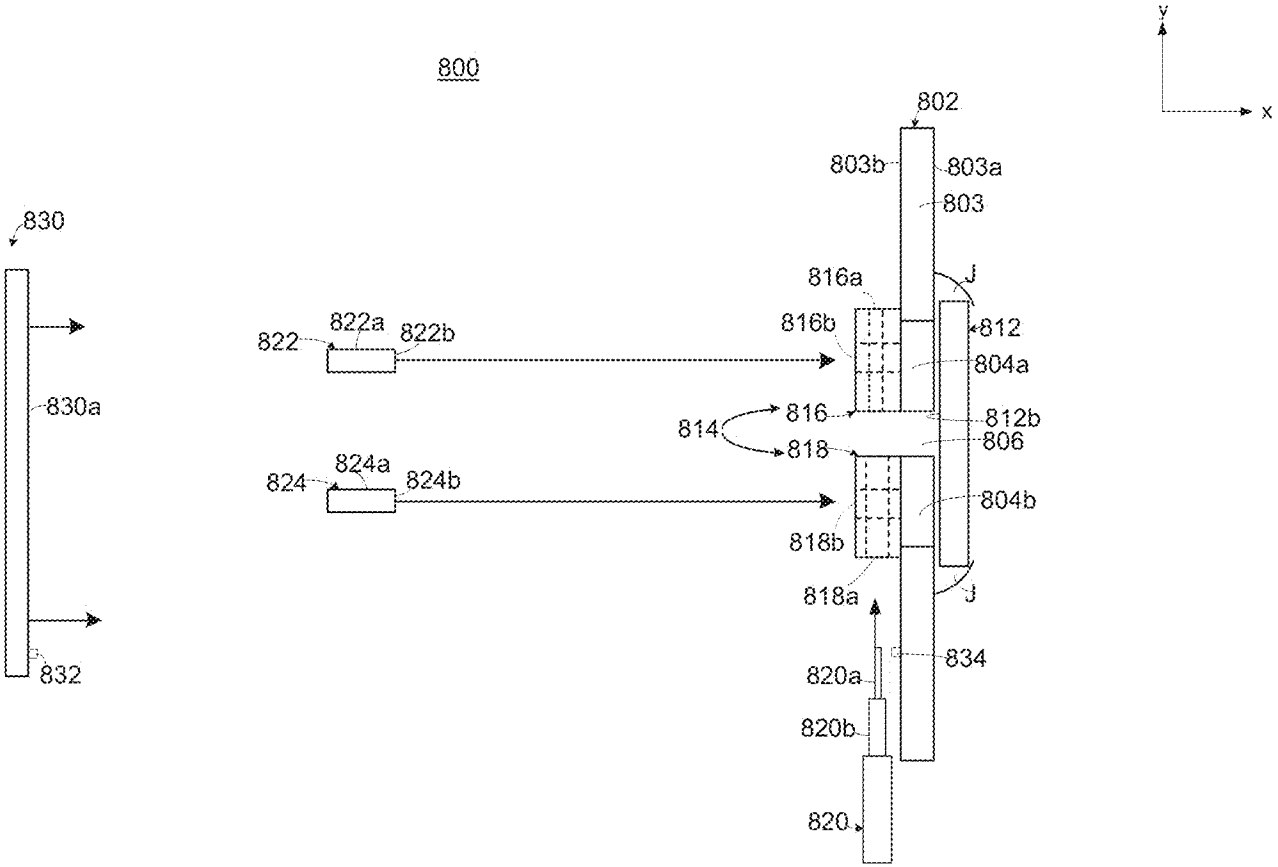
FIG. 8 is a side view of an antenna assembly depicted in a partially assembled configuration, according to another embodiment.

FIG. 8 is a side view of an antenna assembly 800 depicted in a partially assembled configuration, according to another embodiment. The antenna assembly 800 is depicted in the partially assembled configuration for the purpose of descriptive clarity. Antenna assembly 800 includes a slot antenna 802 corresponding to slot antenna 100 described above, and a multi-part signal feed apparatus. Slot antenna 802 includes a conductive wall 803 (which may form part of a device housing), having an exterior surface 803*a* and an interior surface

803*b*, through which a slot is formed (as described above in connection with slot antenna 100). Interior surface 803*b* faces an interior defined by the housing of which conductive wall 803 is a part. Slot antenna 802 includes first and second opposing protuberances 804*a*, 804*b* extending into an opening/slot of the slot antenna to define a narrowed opening 806, also as described above. First and second antenna signal feed-points of antenna 802 coincide with protuberances 804*a*, 804*b* along interior surface 803*b*.

The signal feed apparatus of antenna assembly 800 includes the following parts to be incorporated with slot antenna 802: an electrically non-conductive slot insert 812; an electrically non-conductive block structure 814 (comprising first and second blocks 816, 818); a signal cable 820; first and second electrically conductive plugs 822, 824; and a face plate 830. In an embodiment, face plate 830 is electrically conductive. In another embodiment, face plate 830 is electrically non-conductive.

Slot insert 812, depicted in the assembled configuration in FIG. 8, is fixed to exterior surface 803*a* of slot antenna 802 along its periphery. Slot insert 812 includes an interior surface 812*b* sufficiently large to at least partially cover the slot formed by slot antenna 802. In the depicted embodiment, interior surface 812*b* completely covers the slot. Slot antenna exterior surface 803*a* may include any suitable fastening mechanism to fasten slot insert 812 to the exterior surface. In the embodiment depicted in FIG. 8, exterior surface 803 includes a J-channel "J" along the slot periphery and into which a periphery of slot insert 812 is press-fit, so as to be held in place.

Electrically non-conductive block structure 814, also depicted in the assembled configuration in FIG. 8, comprises first and second non-conductive blocks 816 and 818 separated from each other in a vertical (i.e., y-direction), and each having a surface (not shown in FIG. 8) fixed to interior surface 812*b* of slot insert 812, so as to be positioned adjacent respective ones of protuberances 804*a*, 804*b*, along interior surface 803*b*. (The manner in which blocks 816, 818 may be fixed to slot insert 812 is discussed below in connection with FIG. 13.) This configuration sandwiches protuberances 804*a*, 804*b* between respective ones of first and second blocks 816, and slot insert 812. First and second blocks 816, 818 each include respective first and second cable conduits 816*a*, 818*a* therein extending in the vertical direction and configured to receive a cable therein. First and second blocks 816, 818 also include respective first and second plug receptacle 816*b*, 818*b* therein extending in a horizontal (i.e., x-direction) and in open communication with the corresponding cable conduit. First and second plug sockets 816*b*, 818*b* extend through blocks 816, 818 so as to coincide, or be aligned, with first and second protuberances 804*a*, 804*b* (the first and second signal feed-points) on interior surface 803*b* of slot antenna 802.

In an alternative embodiment, block structure 814 is a unitary member or block in which having a continuous cable conduit therein that would subsume the first and second separated conduits depicted in FIG. 8. The unitary member includes first and second plug receptacles spaced-apart along the continuous conduit so as to coincide with the signal feed-points. Such a unitary block is discussed in connection with FIGS. 13A and 13B below.

Cable 820 is to be inserted into cable conduits 816*a*, 818*a* of blocks 816, 818 in the assembled configuration. Cable 820 includes first and second isolated electrical conductors 820*a*, 820*b*, each exposed along a length of the cable (i.e., in the y-direction) so as to coincided with (and be exposed within) respective ones of plug receptacles 816*b*, 818*b*, when the cable is inserted into cable conduits 816*a*, 818*a*.

First and second plugs 822, 824 (also referred to herein as pins 822, 824) are configured to be inserted into and through respective ones of the plug sockets 816*b*, 818*b* when cable 820 is inserted into cable conduits 816*a*, 818*a*, in the assembled configuration. Plugs 822, 824 and corresponding plug sockets 816*b*, 818*b* may be configured with respect to each other so that once the plugs have been inserted into the sockets, the sockets engage and retain the plugs therein. When plugs 822, 824 are inserted, plug middle portions 822*a*, 824*a* engage or contact the corresponding exposed portions of first and second conductors 820*a*, 820*b* within the corresponding sockets, and plug ends 822*b*, 824*b* contact corresponding protuberances 804*a*, 804*b* along interior surface 803*b*. Thus, inserted plugs 822, 824 electrically connect first and second conductors 820*a*, 820*b* to first and second signal feed-points (the protuberances) on the periphery of the slot of slot antenna 802.

In an embodiment, first and second plugs 822, 824 may be pogo pins, including spring-loaded pogo-pins, and plug receptacles 816*b*, 818*b* may be complimentary pogo pin receptacles. Alternatively, plugs 822, 824 may be threaded screws and receptacles 816*b*, 818*b* complementary threaded receptacles. Many other plug-receptacle configurations are possible, as would be appreciated by those of skill in the relevant arts.

Antenna assembly 802 also includes face plate 830, depicted in the disassembled configuration in FIG. 8, to be positioned within the interior defined by the housing of which conductive wall 802 is a part, and to be fixed to interior surface 803*b* of slot antenna 802 in the assembled configuration. Face plate 830 includes a substantially planar face 830*a* to face interior surface 803*b* of slot antenna 802 and also to face plugs 822, 824 when inserted into blocks 816, 818. Face plate 830 also includes one or more fasteners 832 to engage complementary fasteners 834 on interior surface 803*a* of slot antenna 802, e.g., positioned along the slot periphery of the slot antenna. After plugs 822, 824 are inserted, face plate 830 is fixed to interior surface 803*b* so that face 830*a* presses against (the left or back ends of) inserted plugs 822, 824, thereby assisting in holding the plugs in their respective sockets and in contact with the exposed first and second cable conductors. The assembled configuration obviates the need for soldering of parts.

Figure 9:
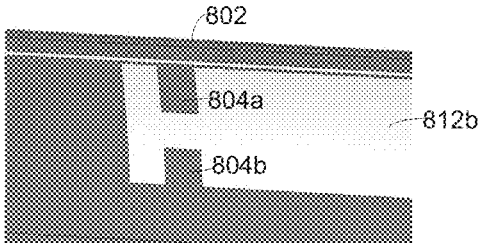
FIG. 9 is an interior view of the antenna assembly of FIG. 8 in a first stage of assembly, in which a slot insert is fixed to an exterior surface of a slot antenna.

FIG. 9 is an interior view of antenna assembly 802 in a first stage of assembly, in which only slot insert 812 is fixed to the exterior (hidden from view in FIG. 9) of slot antenna 802.

Figure 10:
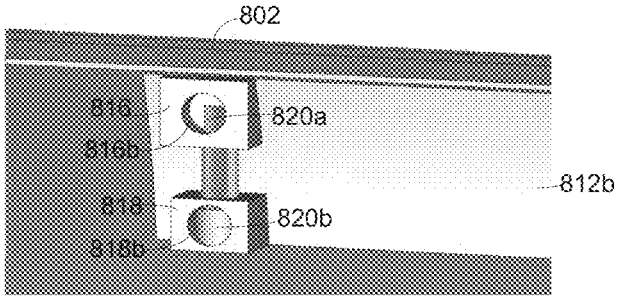
FIG. 10 is an interior view of the antenna assembly of FIG. 8 in a second stage of assembly, in which a slot insert is fixed to an exterior of a slot antenna, first and second blocks are fixed to an interior surface of the slot insert, and exposed portions of first and second conductors are inserted into corresponding ones of the blocks.

FIG. 10 is an interior view of antenna assembly 802 in a second stage of assembly, in which slot insert 812 is fixed to the exterior of slot antenna 802, first and second blocks 816, 818 are fixed to interior surface 812*b* of slot insert 812, and exposed portions of first and second conductors 820*a*, 820*b* are inserted into corresponding blocks 816, 818 (and able to be viewed through corresponding plug receptacles 816*b*, 818*b*).

Figure 11:
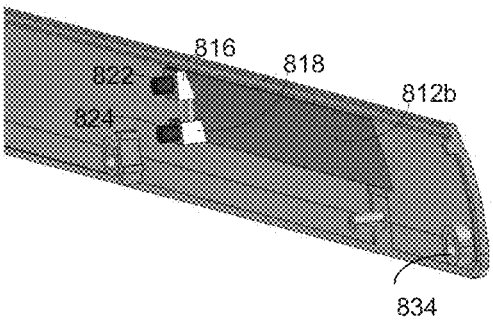
FIG. 11 is an interior view of the antenna assembly of FIG. 8 in a third stage of assembly, in which first and second plugs are inserted into corresponding block structures to engage corresponding conductors, and protuberances (or signal feed-points) on opposing sides of a slot antenna.

FIG. 11 is an interior view of antenna assembly 802 in a third stage of assembly, in which plugs 822, 824 are inserted into corresponding blocks 816, 818, thereby engaging corresponding conductors 820*a*, 820*b* within their respective conduits, and protuberances 804*a*, 804*b* (the signal feed-points) on opposing sides of the slot of slot antenna 802.

Figure 12:
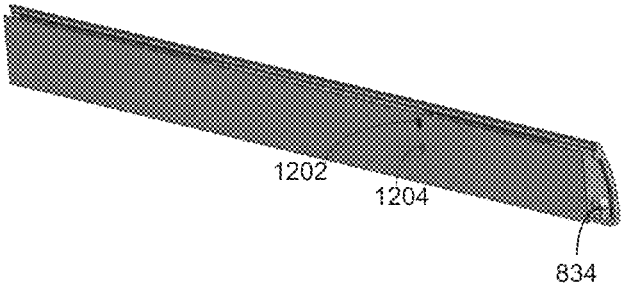
FIG. 12 is an interior view of the antenna assembly of FIG. 8 in a fourth stage of assembly, in which a face plate is brought near an interior surface of a slot antenna to contact first and second plugs of the slot antenna.

FIG. 12 is an interior view of antenna assembly 802 in a fourth stage of assembly, in which face plate 830 is brought near interior surface 803*b* to contact plugs 822, 824 (situated on opposing sides of spot areas 1202, 1204 depicted in FIG. 12) and to be fastened to the interior surface at fastener 834.

The manner in which blocks 816, 818 are fixed to slot insert 812 is now described with reference to FIG. 13.

Figure 13:
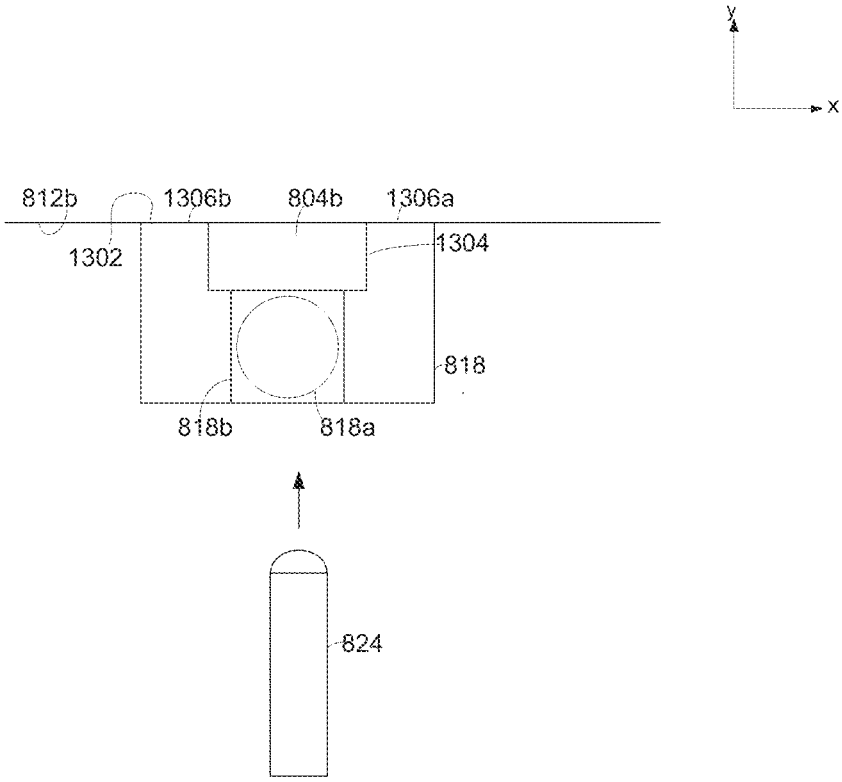
FIG. 13 is a top cutaway view of a block from FIG. 8.

FIG. 13 is a top view of block 818 into which plug 824 is to be inserted. Block 818 has a front face 1302 facing interior surface 812*b* of insert 812. Front face 1302 has a width (i.e., in the x-direction) that is wider than a width of protuberance 804*b*. Block 818 also includes a recess or groove 1304 formed centrally within front face 1302 and wide enough to fully receive protuberance 804*a*, but narrow enough to leave edges 1306*a*, 1306*b* of front face 1302 straddling protuberance 804*b* and adjacent coextensive portions of slot insert surface 812*b*. Edges 1306*a*, 1306*b* of block 818 are fixed to slot insert surface 812*b* using, for example, a suitable epoxy or glue, or by heat fusing, as would be appreciated by those of ordinary skill in the relevant arts. Block 816 is configured similarly to block 818 and thereby fixed to slot insert surface 812*b* adjacent protuberance 804*a*.

Figure 13A:
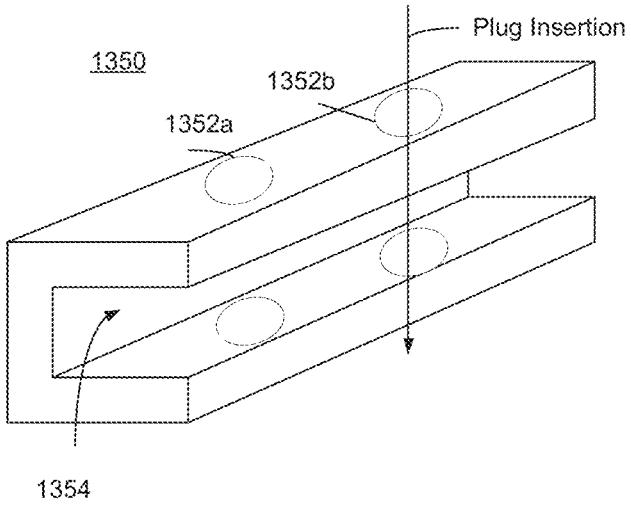
FIG. 13A is a perspective view of a unitary block for the antenna assembly of FIG. 8, according to an embodiment.
Figure 13B:
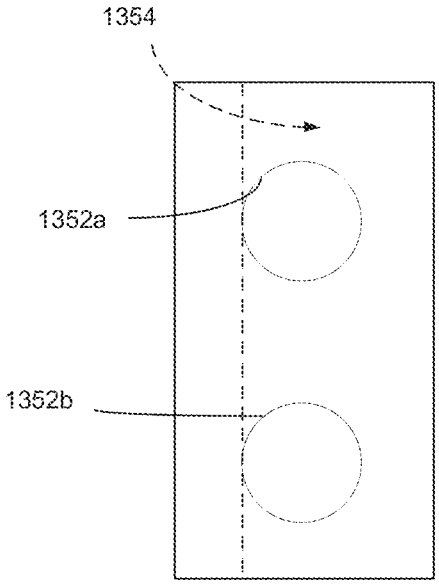
FIG. 13B is a top view of the unitary block of FIG. 13A.

FIGS. 13A and 13B are diagrams of a non-conductive block structure (or "block") 1350 for antenna assembly 800, which combines separated blocks 816 and 818 of FIG. 8 into a unitary structure, according to an embodiment. FIG. 13A is a perspective view of unitary block 1350, while FIG. 13B is a top view of the unitary block. Unitary block 1350 is configured to be fixed to slot insert 812 (instead of blocks 816, 818) and includes spaced-apart plug sockets 1352*a*, 1352 coinciding with first and second protuberances 804*a*, 804*b* (and the first and second feed-points), respectively, and a continuous cable conduit 1354 in open communication with the plug sockets. In the embodiment depicted in FIGS. 13A and 13B, cable conduit 1354 is open on one side (the right-hand side). Alternatively, the cable conduit (1354) may include a wall to close the conduit from the right-hand side, leaving cable openings only on opposing ends of the block.

Figure 14:
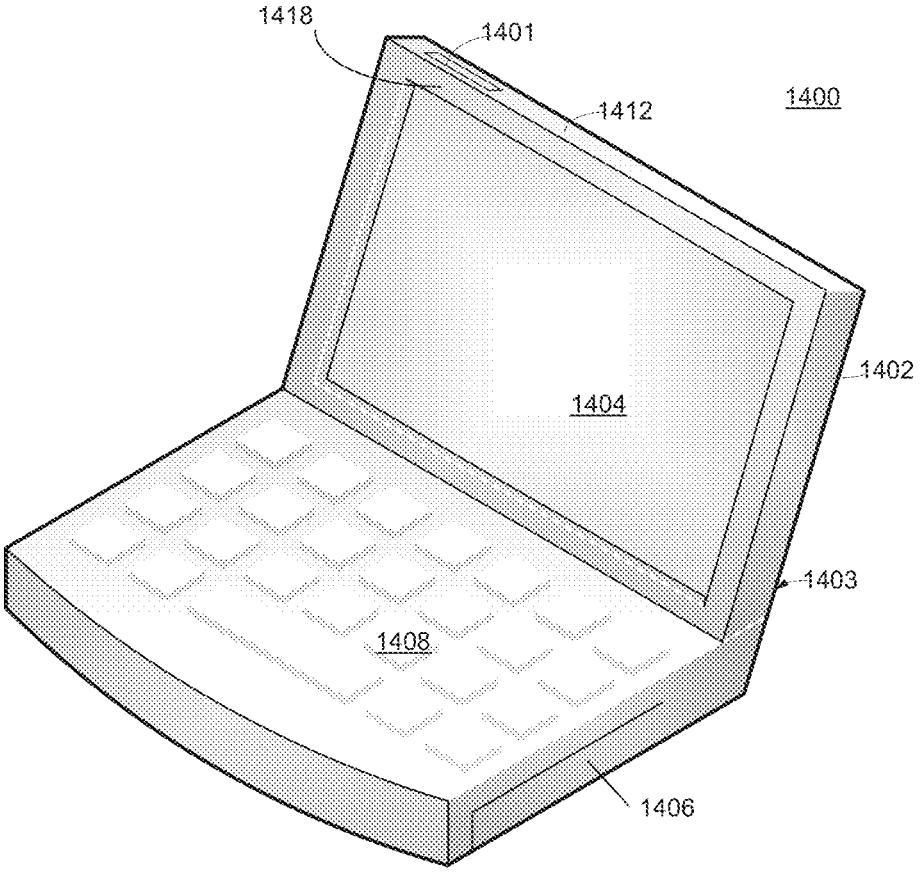
FIG. 14 is a diagram of communication device integrated with an antenna assembly, according to an embodiment.

FIG. 14 is a diagram of a communication device 1400 integrated with an antenna assembly 1401 corresponding to either of antenna assemblies 200 and 800, according to an embodiment. Device 1400 may be a portable communication device such as a smartphone, notebook, or ultrabook computer, which includes a communication system to wirelessly communicate via antenna assembly 1401. Device 1400 may have a chassis or housing 1403 in a clam-shell configuration, including a top 1402, e.g., a flip-up top, and a bottom 1406 pivotally connected to top 1402 so that the housing may be opened and closed by a user, as would be appreciated by those of ordinary skill in the relevant arts. Top 1402 includes a front wall to house a display 1404, while bottom 1406 may house a keyboard 1408. As depicted in FIG. 14, top 1402 is flipped-open to expose display 1404. However, when housing 1403 is closed, display 1404 and keyboard 1408 face each other. In an exemplary embodiment, antenna assembly 1401, including its conductive wall and slot, is positioned within a top border wall 1412 of top 1402. When so positioned, antenna 1401 faces away from, and is not obstructed physically or radiatively by, bottom 1406 when housing 1403 is either open or closed. Therefore, antenna 1401 is free to radiate (and receive) RF signals when housing 1403 is open or closed.

In another embodiment, antenna 1401 may be integrated in a conductive portion of a front border wall 1418 of top 1402.

Figure 14A:
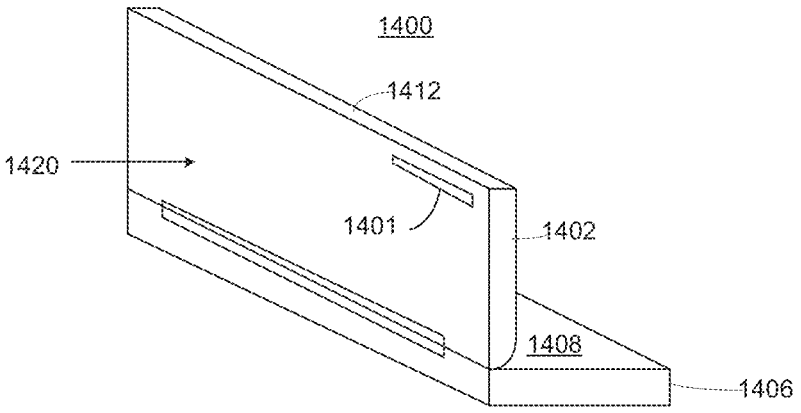
FIG. 14A is a diagram of the communication device of FIG. 14 integrated with an antenna assembly, according to another embodiment.

In another embodiment, depicted in FIG. 14A, antenna assembly 1401 may be positioned in a back wall 1420 (that opposes the front wall in which display 1404 is housed) of housing 1403, so that antenna 1401 faces away from, and is not obstructed physically or radiatively by, bottom 1406 when housing 1403 is either open or closed In each of the antenna assembly placement embodiments described above in connection with FIGS. 14 and 14A, top 1402 defines an interior of housing 1403 into which portions of antenna assembly 1401 are positioned or extend, whether antenna assembly 1401 corresponds to antenna assembly 200 or antenna assembly 800. For example, with reference again to FIG. 3, where antenna assembly 1401 corresponds to antenna assembly 200, signal connector free-ends 210*d*, 212*d* extend into the housing interior (e.g., see housing interior 310 in FIG. 3). With reference again to FIG. 8, where antenna assembly 1401 corresponds to antenna assembly 800, blocks 814, plugs 822, 824, and face plate 830 extend into or are positioned within the housing interior. Specifically, face plate 830 is positioned within the housing interior and includes surface 830*a* to face conductive wall 803, and to press against the back ends of plugs 822, 824 when the face plate is fixed to the housing.

Systems disclosed herein may be implemented with respect to one or more of a variety of systems including one or more consumer systems, such as described below with reference to FIG. 15. Systems disclosed herein are not, however, limited to the example of FIG. 15.

Figure 15:
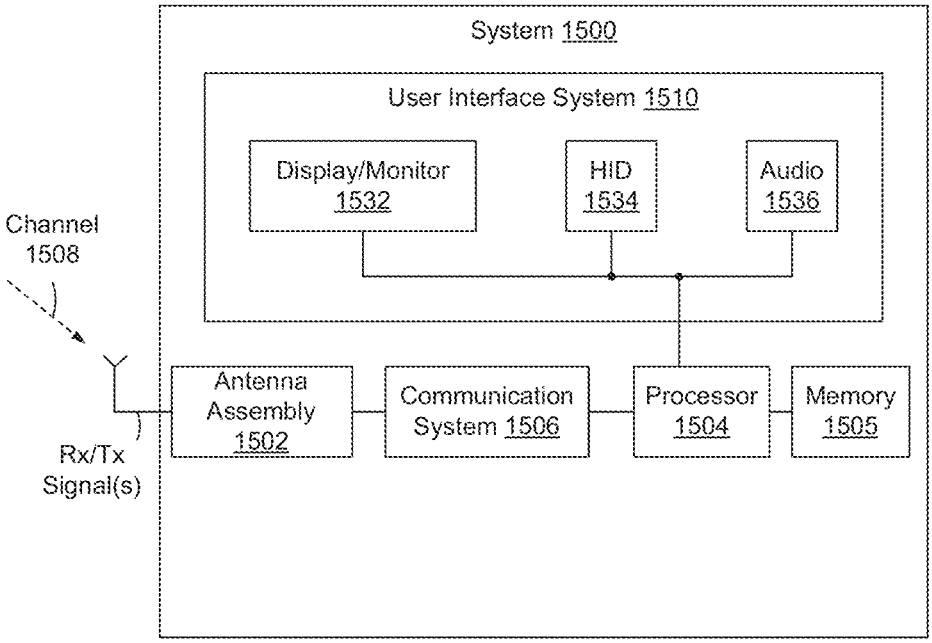
FIG. 15 is a block diagram of a system including an antenna assembly to receive and transmit wireless signals, such as radio frequency (RF) signals, according to an embodiment.

FIG. 15 is a block diagram of a system 1500 including an antenna assembly 1502 to receive and transmit, i.e., transceive, wireless signals, such as RF signals.

Antenna assembly 1502 may be implemented as described in one or more examples herein.

System 1500 may include one or more processors 1504 coupled with a memory 1505.

System 1500 may include a communication system 1506 to interface between processor system 1504 and a communication network over a channel 1508. Communication system 1506 may include a wired and/or wireless communication system, and, when wireless, the communication system transceives wireless signals using antenna assembly 1502.

System 1500 or portions thereof may be implemented within one or more integrated circuit dies, and may be implemented as a system-on-a-chip (SoC).

System 1500 may include a user interface system 1510 to interface system 1510.

User interface system 1510 may include a monitor or display 1532 to display information from processor 1504.

User interface system 1510 may include a human interface device (HID) 1534 to provide user input to processor 1504. HID 1534 may include, for example and without limitation, one or more of a key board, a cursor device, a touch-sensitive device, and or a motion and/or image sensor. HID 1534 may include a physical device and/or a virtual device, such as a monitor-displayed or virtual keyboard.

User interface system 1510 may include an audio system 1536 to receive and/or output audible sound.

System 1500 may further include a transmitter system to transmit signals from system 1500.

System 1500 may correspond to, for example, a computer system, a personal communication device, and/or a television set-top box.

System 1500 may include a housing, and one or more of communication system 1502, digital processor system 1512, user interface system 1510, or portions thereof may be positioned within the housing. The housing may include, without limitation, a rack-mountable housing, a desk-top housing, a lap-top housing, a notebook or ultrabook housing, a net-book housing, a set-top box housing, a portable housing, and/or other conventional electronic housing and/or future-developed housing. For example, communication system 1502 may be implemented to receive a digital television broadcast signal, and system 1500 may include a set-top box housing or a portable housing, such as a mobile telephone housing.

Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed.

Apparatus and system embodiments are described herein.

A first apparatus embodiment includes a signal feed apparatus for an antenna including a slot through an electrically conductive wall. The signal feed apparatus comprises:

a non-conductive slot insert to be fixed to the conductive wall and sized to at least partially cover the slot; and a signal connector having first and second electrically isolated conductors fixed relative to each other, each including a base configured to be positioned between the slot insert and a corresponding one of first and second signal feed-points of the antenna, and to be pressed into contact with the one of the signal feed-points by the slot insert when fixed to the conductive wall, and a free-end, extending away from the base, to mate with a complimentary signal connector.

The apparatus further comprising a fastening mechanism to fix the slot insert to the conductive wall.

The fastening mechanism may include one of a friction fit connector and a snap connector fixed to a periphery of the slot insert to engage a complementary connector fixed to the conductive wall.

The first and second conductor bases each extend in a transvers direction, and the first and second conductor free-ends extend away from their respective bases in an axial direction orthogonal to the transverse direction. The slot insert includes a periphery to be fixed to a periphery of the slot, and a recessed area, interior to the periphery of the slot insert, configured to receive the first and second conductor bases, wherein the first and second conductor bases are each configured to be sandwiched between a corresponding one of the first and second signal feed-points and the recessed area when the slot insert is fixed to the conductive wall.

The first and second conductor bases each extend in a transverse direction and the first and second conductor free-ends each extend away from their respective bases in an axial direction substantially orthogonal to the transverse direction.

The conductive wall includes a periphery defining the slot, the periphery having at least one protuberance thereon that extends into the slot and that coincides with at least one of the first and second signal feed-points.

The periphery includes first and second opposing sides each having a protuberance thereon that extends into the slot toward the opposing side and coincides with a corresponding one of the first and second signal feed-points.

The first and second conductor free-ends comprise a coaxial connector.

The apparatus also includes:

a wireless communication system to communicate with a network;

a memory;

a processor to interface between the wireless communication system, a user interface system, and the memory; and a housing, of which the conductive wall forms a part, to house the wireless communication system, the memory, the processor, and the user interface system.

The housing includes a mobile hand-held housing to further receive a battery.

A first system embodiment comprises:

a wireless communication system to communicate with a network;

a memory;

a processor to interface between the wireless communication system, a user interface system, and the memory;

a housing to house the wireless communication system, the memory, the processor, and the user interface system; and a signal feed apparatus for an antenna formed as a slot through a conductive wall of the housing, comprising:

a non-conductive slot insert to be fixed to the conductive wall and sized to at least partially cover the slot; and a signal connector having first and second electrically isolated conductors fixed relative to each other, each including a base configured to be positioned between the slot insert and a corresponding one of first and second signal feed-points of the antenna, and to be pressed into contact with the one of the signal feed-points by the slot insert when fixed to the conductive wall, and a free-end, extending away from the base, to mate with a complimentary signal connector.

A second apparatus embodiment includes a signal feed apparatus for an antenna formed as a slot through an electrically conductive wall of a housing. The apparatus includes:

a non-conductive slot insert sized to at least partially cover the slot;

a non-conductive block structure, to be fixed to the slot insert, including one or more cable conduits and spaced-apart first and second plug sockets each in open communication with the one or more cable conduits, and each extending through the block structure to coincide respectively with spaced-apart first and second signal feed-points of the antenna on a periphery of the slot;

a signal cable to be inserted into the one or more cable conduits and including electrically isolated first and second electrical conductors; and first and second plugs to be inserted respectively into the first and second plug sockets, and thereby electrically connect the first and second electrical conductors to the first and second signal feed-points, respectively.

The slot insert is configured to be fixed to the slot periphery.

The first and second signal feed-points may be positioned on opposing sides of the slot periphery, and the block structure is configured to be fixed to a surface of the slot insert so that the first and second feed-points are sandwiched, respectively, between portions of the block structure having the first and second plug sockets therein and the slot insert surface.

The signal cable may be a coaxial cable and the first and second conductors are inner and outer conductors of the coaxial cable, wherein the first and second plugs are configured to connect respective ones of the inner and outer conductors in their respective plug sockets to respective ones of the first and second signal feed-points when inserted.

The apparatus further comprises a face plate to be positioned within an interior of the housing and fixed to the housing, the face plate having a surface to face the conductive wall, and thereby press the first and second plugs into their respective plug sockets when the face plate is fixed to the housing.

The housing may include a top defining the housing interior and being pivotally connected to a bottom of the housing so that the housing is able to be opened and closed like a book, the conductive wall being positioned in the housing top so as to face away from the housing bottom when the housing is closed.

The face plate may be electrically conductive.

The block structure may include two spaced-apart non-conductive blocks each to be fixed to a surface of the slot insert that covers the slot and having therein a respective one of the first and second cable conduits and a respective one of the plug sockets.

The block structure may be a unitary member, to be fixed to a surface of the slot insert that covers the slot, in which the first and second cable conduits form a continuous conduit, the first and second plug receptacles being spaced-apart along the continuous conduit so as to coincide with the signal feed-points.

The first and second plugs are pogo pins and the first and second plug sockets are pogo pin sockets.

The slot periphery includes first and second opposing sides, at least one of the first and second opposing sides having a protuberance thereon that extends into the slot toward the opposing side and that coincides with at least one of the first and second signal feed-points of the slot antenna.

The first and second opposing sides of the slot each have a protuberance thereon that extends into the slot toward the opposing side and coincides with a corresponding one of the first and second signal feed-points.

The apparatus further comprises:

a wireless communication system to communicate with a network;

a memory; and a processor to interface between the wireless communication system, a user interface system, and the memory, wherein the housing is configured to house the wireless communication system, the memory, the processor, and the user interface system.

The housing includes a mobile hand-held housing to further receive a battery.

A second system embodiment comprises:

a wireless communication system to communicate with a network;

a memory;

a processor to interface between the wireless communication system, a user interface system, and the memory;

a housing to house the wireless communication system, the memory, the processor, and the user interface system; and a signal feed apparatus for an antenna formed as a slot through a conductive wall of the housing, comprising:

a non-conductive slot insert sized to at least partially cover the slot;

a non-conductive block structure, to be fixed to the slot insert, including one or more cable conduits and spaced-apart first and second plug sockets in open communication with the one or more cable conduits, the first and second plug sockets extending through the block structure to coincide respectively with spaced-apart first and second signal feed-points of the antenna on a periphery of the slot;

a signal cable to be inserted into the one or more cable conduits and including electrically isolated first and second electrical conductors; and first and second plugs to be inserted respectively into the first and second plug sockets, and thereby electrically connect the first and second electrical conductors to the first and second signal feed-points, respectively.

While various embodiments are disclosed herein, it should be understood that they have been presented by way of example only, and not limitation. It will be apparent to persons skilled in the relevant art that various changes in form and detail may be made therein without departing from the spirit and scope of the methods and systems disclosed herein. Thus, the breadth and scope of the claims should not be limited by any of the example embodiments disclosed herein.

What is claimed is:

1. A signal feed apparatus for an antenna including a slot through an electrically conductive wall, comprising:

a non-conductive slot insert to be fixed to the conductive wall and sized to at least partially cover the slot; and a signal connector having first and second electrically isolated conductors fixed relative to each other, each including a base configured to be positioned between the slot insert and a corresponding one of first and second signal feed-points of the antenna, and to be pressed into contact with the one of the signal feed-points by the slot insert when fixed to the conductive wall, and a free-end, extending away from the base, to mate with a complimentary signal connector.

2. The apparatus of claim 1, further comprising a fastening mechanism to fix the slot insert to the conductive wall.

3. The apparatus of claim 2, wherein the fastening mechanism includes one of a friction fit connector and a snap connector fixed to a periphery of the slot insert to engage a complementary connector fixed to the conductive wall.

4. The apparatus of claim 1, wherein:

the first and second conductor bases each extend in a transvers direction, and the first and second conductor free-ends extend away from their respective bases in an axial direction orthogonal to the transverse direction; and the slot insert includes a periphery to be fixed to a periphery of the slot, and a recessed area, interior to the periphery of the slot insert, configured to receive the first and second conductor bases, wherein the first and second conductor bases are each configured to be sandwiched between a corresponding one of the first and second signal feed-points and the recessed area when the slot insert is fixed to the conductive wall.

5. The apparatus of claim 1, wherein the first and second conductor bases each extend in a transverse direction and the first and second conductor free-ends each extend away from their respective bases in an axial direction substantially orthogonal to the transverse direction.

6. The apparatus of claim 1, wherein the conductive wall includes a periphery defining the slot, the periphery having at least one protuberance thereon that extends into the slot and that coincides with at least one of the first and second signal feed-points.

7. The apparatus of claim 6, wherein the periphery includes first and second opposing sides each having a protuberance thereon that extends into the slot toward the opposing side and coincides with a corresponding one of the first and second signal feed-points.

8. The apparatus of claim 1, wherein the first and second conductor free-ends comprise a coaxial connector.

9. A system, comprising:

a wireless communication system to communicate with a network;

a memory;

a processor to interface between the wireless communication system, a user interface system, and the memory; and a housing to house the wireless communication system, the memory, the processor, and the user interface system; and a signal feed apparatus for an antenna formed as a slot through an electrically conductive wall of the housing, comprising:

a non-conductive slot insert to be fixed to the conductive wall and sized to at least partially cover the slot; and a signal connector having first and second electrically isolated conductors fixed relative to each other, each including a base configured to be positioned between the slot insert and a corresponding one of first and second signal feed-points of the antenna, and to be pressed into contact with the one of the signal feed-points by the slot insert when fixed to the conductive wall, and a free-end, extending away from the base, to mate with a complimentary signal connector.

10. The system of claim 9, wherein the housing includes a mobile hand-held housing to further receive a battery.

11. A signal feed apparatus for an antenna formed as a slot through an electrically conductive wall of a housing, comprising:

a non-conductive slot insert sized to at least partially cover the slot;

a non-conductive block structure, to be fixed to the slot insert, including one or more cable conduits and spaced-apart first and second plug sockets each in open communication with the one or more cable conduits, and each extending through the block structure to coincide respectively with spaced-apart first and second signal feed-points of the antenna on a periphery of the slot;

a signal cable to be inserted into the one or more cable conduits and including electrically isolated first and second electrical conductors; and first and second plugs to be inserted respectively into the first and second plug sockets, and thereby electrically connect the first and second electrical conductors to the first and second signal feed-points, respectively.

12. The apparatus of claim 11, wherein the slot insert is configured to be fixed to the slot periphery.

13. The apparatus of claim 11, wherein the first and second signal feed-points are positioned on opposing sides of the slot periphery, and the block structure is configured to be fixed to a surface of the slot insert so that the first and second feed-points are sandwiched, respectively, between portions of the block structure having the first and second plug sockets therein and the slot insert surface.

14. The apparatus claim 11, wherein the signal cable is a coaxial cable and the first and second conductors are inner and outer conductors of the coaxial cable, wherein the first and second plugs are configured to connect respective ones of the inner and outer conductors in their respective plug sockets to respective ones of the first and second signal feed-points when inserted.

15. The apparatus of claim 11, further comprising a face plate to be positioned within an interior of the housing and fixed to the housing, the face plate having a surface to face the conductive wall, and thereby press the first and second plugs into their respective plug sockets when the face plate is fixed to the housing.

16. The apparatus of claim 15, wherein the housing includes a top defining the housing interior and being pivotally connected to a bottom of the housing so that the housing is able to be opened and closed like a book, the conductive wall being positioned in the housing top so as to face away from the housing bottom when the housing is closed.

17. The apparatus of claim 15, wherein the face plate is electrically conductive.

18. The apparatus of claim 11, wherein the block structure includes two spaced-apart non-conductive blocks each to be fixed to a surface of the slot insert that covers the slot and having therein a respective one of the first and second cable conduits and a respective one of the plug sockets.

19. The apparatus of claim 11, wherein the block structure is a unitary member, to be fixed to a surface of the slot insert that covers the slot, in which the first and second cable conduits form a continuous conduit, the first and second plug receptacles being spaced-apart along the continuous conduit so as to coincide with the signal feed-points.

20. The apparatus of claim 11, wherein the first and second plugs are pogo pins and the first and second plug sockets are pogo pin sockets.

21. The apparatus of claim 11, wherein the slot periphery includes first and second opposing sides, at least one of the first and second opposing sides having a protuberance thereon that extends into the slot toward the opposing side and that coincides with at least one of the first and second signal feed-points of the slot antenna.

22. The apparatus of claim 21, wherein the first and second opposing sides each have a protuberance thereon that extends into the slot toward the opposing side and coincides with a corresponding one of the first and second signal feed-points.

23. A system, comprising:

a wireless communication system to communicate with a network;

a memory;

a processor to interface between the wireless communication system, a user interface system, and the memory;

a housing to house the wireless communication system, the memory, the processor, and the user interface system; and a signal feed apparatus for an antenna formed as a slot through an electrically conductive wall of the housing, comprising:

a non-conductive slot insert sized to at least partially cover the slot;

a non-conductive block structure, to be fixed to the slot insert, including one or more cable conduits and spaced-apart first and second plug sockets each in open communication with the one or more cable conduits, and each extending through the block structure to coincide respectively with spaced-apart first and second signal feed-points of the antenna on a periphery of the slot;

a signal cable to be inserted into the one or more cable conduits and including electrically isolated first and second electrical conductors; and first and second plugs to be inserted respectively into the first and second plug sockets, and thereby electrically connect the first and second electrical conductors to the first and second signal feed-points, respectively.

24. The system of claim 23, wherein the housing includes a mobile hand-held housing to further receive a battery.

* * * * *

UNITED STATES PATENT AND TRADEMARK OFFICE

CERTIFICATE OF CORRECTION

PATENT NO. : 8,766,862 B2
APPLICATION NO. : 13/536448
DATED : July 1, 2014
INVENTOR(S) : Anand S. Konanur et al.

It is certified that error appears in the above-identified patent and that said Letters Patent is hereby corrected as shown below:

IN THE CLAIMS:

In column 12, line 18-19, In Claim 4, delete “transvers” and insert -- transverse --, therefor.

In column 13, line 37, In Claim 14, after “apparatus” insert -- of --.

Signed and Sealed this
Thirtieth Day of December, 2014

Michelle K. Lee

Michelle K. Lee
*Deputy Director of the United States Patent and Trademark Office*